US008601990B2

(12) United States Patent
Meintschel et al.

(10) Patent No.: US 8,601,990 B2
(45) Date of Patent: Dec. 10, 2013

(54) VALVE OPERATING DEVICE

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 393 days.

(21) Appl. No.: 12/799,789

(22) Filed: Apr. 30, 2010

(65) Prior Publication Data

US 2010/0236505 A1 Sep. 23, 2010

Related U.S. Application Data

(63) Continuation-in-part of application No. PCT/EP2008/008618, filed on Oct. 11, 2008.

(30) Foreign Application Priority Data

Nov. 2, 2007 (DE) ..... 10 2007 052 254

(51) Int. Cl.
*F01L 1/34* (2006.01)

(52) U.S. Cl.
USPC ..... 123/90.18; 123/90.11

(58) Field of Classification Search
USPC ..... 123/90.15, 90.18, 90.6, 90.1, 90.11, 123/90.16; 701/113
See application file for complete search history.

(56) References Cited

U.S. PATENT DOCUMENTS

| | | | | |
|---|---|---|---|---|
| 4,683,452 | A * | 7/1987 | Henley | 335/234 |
| 6,343,578 | B1 * | 2/2002 | Kerkau et al. | 123/90.15 |
| 6,967,550 | B2 * | 11/2005 | Elendt et al. | 335/229 |
| 2007/0034184 | A1 * | 2/2007 | Dengler | 123/90.17 |

FOREIGN PATENT DOCUMENTS

| | | |
|---|---|---|
| DE | 195 19 048 | 11/1996 |
| DE | 201 14 466 | 2/2002 |
| DE | 10 2004 008 670 | 9/2005 |
| WO | WO 2006/030434 | 3/2006 |

* cited by examiner

*Primary Examiner* — Thomas Denion
*Assistant Examiner* — Daniel Bernstein
(74) *Attorney, Agent, or Firm* — Klaus J. Bach

(57) ABSTRACT

In a valve operating device for an internal combustion engine with at least one actuating device which is provided to adjust an axially displaceable cam element by means of at least one slotted guide track, the valve operating device comprises a safety unit for moving the axially displaceable cam element in at least one operating mode into a defined basic safety position.

6 Claims, 2 Drawing Sheets

VALVE OPERATING DEVICE

This is a Continuous-In-Part Application of pending international patent application PCT/EP2008/008618 filed Oct. 11, 2008 and claiming the priority of German patent application 10 2007 052 254.3 filed Nov. 2, 2007.

BACKGROUND OF THE INVENTION

The invention relates to a valve operating device of an internal combustion engine.

A valve operating devices, in particular for an internal combustion engine with at least one actuating device, which is provided to adjust an axially displaceable cam element by means of at least one slotted guide track are well-known in the art.

It is the principal object of the invention to provide a valve operating device, in which a risk of damage by a disadvantageous position of the cam element is reduced.

SUMMARY OF THE INVENTION

In a valve operating device for an internal combustion engine with at least one actuating device which is provided to adjust an axially displaceable cam element by means of at least one slotted guide track, the valve operating device comprises a safety unit for moving the axially displaceable cam element in at least one operating mode into a defined basic safety position.

The "defined basic safety position" is a position of the cam element, in which a basic function of the valve operating device, as in particular an opening of gas exchange valves at non-critical times, is possible. Such a valve device can be provided in a simple manner by means of the arrangement of the invention, where the cam element assures a defined position, in particular, after a malfunction of the actuating device. An operation in which different cam elements have different positions, can be avoided thereby, so that the chances of damage to the valve operating device can be reduced. The safety device is advantageously independent of electronic control units.

It is further suggested that the safety unit or device has a slotted guide track, which is arranged on the cam element, and which is provided to move the cam element into the defined basic safety position. A safety unit can thereby be realized in a simple manner and with a low expenditure of components.

Preferably, the safety device has at least one actuating plunger, which is provided to extend into the slotted guide track. An actuation of the cam element, by means of which the cam element is moved into the basic safety position, can be achieved thereby in a simple manner.

The actuating device is preferably formed integrally with the safety device. The number of components required can thereby be reduced, whereby a particularly cost-efficient safety device can be provided.

Preferably, the safety device is activated depending on at least one operating parameter. The safety device can thereby be adapted in a targeted manner to operating states in which a malfunction is particularly probable.

Preferably, the safety device is activated depending on an operating temperature. It can thereby be ensured that the cam element is in the defined basic safety position in particular during a cold start, as a malfunction can occur in particular when the internal combustion engine is switched off caused by a fault, and in particular, a false position of the cam element.

The safety device is advantageously self-switching. "Self-switching" means that a sensor system is provided which determines the operating temperature, for example a temperature sensor, and an actuator system designed separately from the sensor system. A servo-motor, which is designed separately from the sensor system is therefore not needed. A safety device can thereby be particularly reliable. The sensor system, which is in particular a thermally active element, and the actuator system, which is an element activating the safety device, are preferably integrally formed.

The safety device preferably comprises a spring means. A self-switching safety device, which is independent of electrical actuators and/or control units, can thereby be realized in a simple manner. The spring means is advantageously designed as a thermally active spring member, for example, a bimetallic spring.

Preferably, the safety device includes a switch-off unit for deactivating the safety unit. The safety device can thereby be deactivated in a targeted manner, for example, when an operating state is present, in which no malfunction is possible, and the actuating device is supposed to adjust the cam element.

If the switch-off unit comprises an electromagnetic unit, an efficient switch-off device can be realized in a particularly simple manner.

The invention will become more readily apparent from the following description of a particular embodiment thereof with reference to the accompanying drawings.

DETAILED DESCRIPTION OF A PARTICULAR EMBODIMENT

Figure 1:
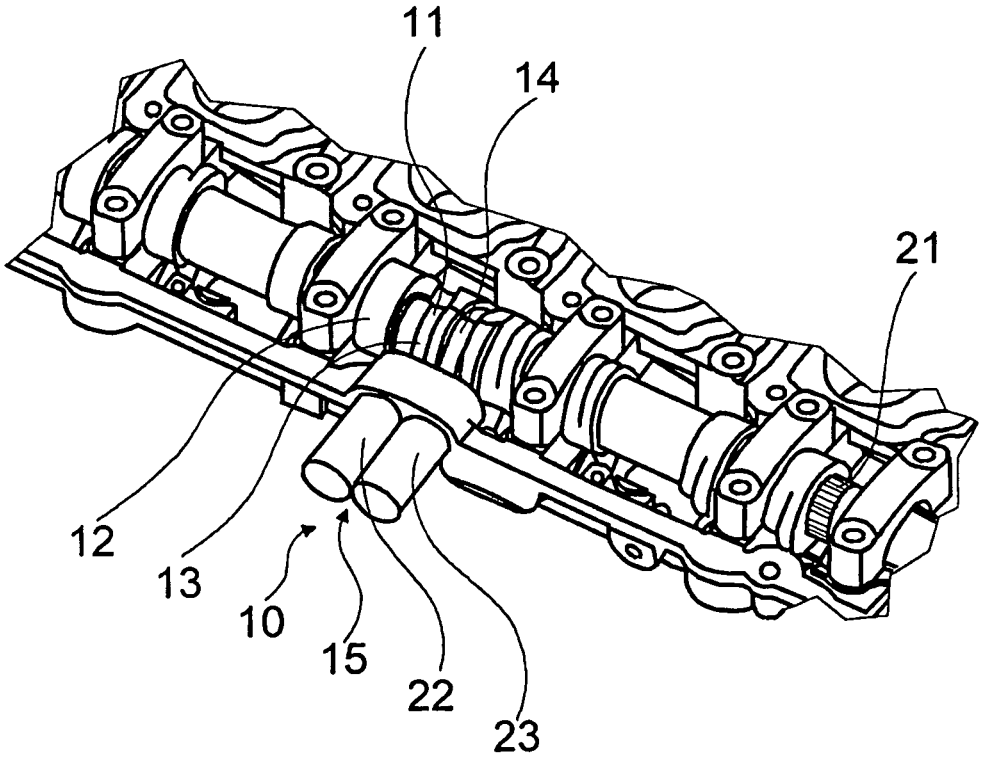
FIG. 1 shows a valve operating device.

FIG. 1 shows an arrangement of a valve operating device of an internal combustion engine according to the invention. The valve operating device has an axially displaceable cam element 12, which is arranged on a cam shaft 21 and which makes a switchable valve operation possible.

Figure 2:
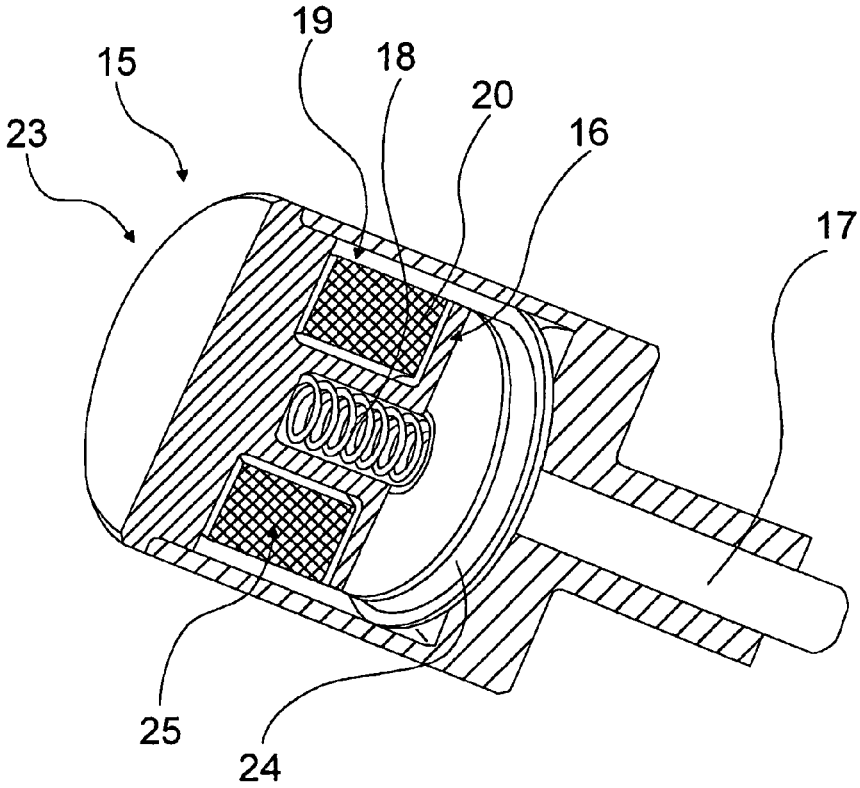
FIG. 2 shows a safety device of the valve operating device.

According to the invention, the valve operating device includes a safety device 15, which moves the cam element 12 during an operating mode, in which a malfunction is present, into a defined basic safety position (FIG. 2).

The valve operating device further has an actuating device 10, by means of which the valve operation can be switched. The actuating device 10 has two actuators 22, 23. The first actuator 22 is provided to move the cam element 12 by means of a first slotted guide track 13 into a switching position, the second actuator 23 is provided to move the cam element 12 by means of a second slotted guide track 14 into a basic position, which forms the defined basic safety position. The safety device 15 is formed largely by the second actuator 23 and the second slotted guide track 14 of the actuating device 10.

The actuator 23 comprises an actuating plunger 17, which can be moved into the slotted guide track. The valve operation is switched by means of the slotted guide track 14. The actuator 22 which extends into the slotted guide track 13, is formed correspondingly.

The actuating plunger 17 of the actuator 23 has two base positions in which it can remain when no forces act on the actuating plunger 17. In a first position, the actuating plunger 17 is retracted and is disposed outside the slotted guide track 14. If the valve operation is to be switched, the actuating plunger 17 is moved to a second position in which it enters the slotted guide track 14, whereby the valve operation is switched. The actuating plunger 17 is moved by an actuating unit 16, which includes an electromagnetic unit 25. The electromagnetic unit 25 is supplied with current via a control and/or regulation unit, not shown in detail. In dependence on a direction of a current flow, a force acts on the actuating plunger 17, which is directed in the direction of the first position or of the second position. In an operating mode in which the valve operating device is to be switched, the electromagnetic unit 25 is energized such that the force acting on the actuating plunger 17 is directed in the direction of the second position, or toward the slotted guide track 14. The actuating plunger 17 is moved thereby into the slotted guide track 14. The actuating plunger 17 is subsequently moved back into the first position due to a rotational movement of the cam shaft element 12 and an ascending base of the groove of the slotted guide track 14.

In order to provide the safety device 15, which is largely formed integrally with the actuating device 10, the actuator 23 includes a spring 18, which has a temperature-dependent spring force. The spring 18 is a bimetallic spring, whose spring force changes with the operating temperature due to differently expanding metals, whereby the safety device becomes self-switching.

In an operating state, in which in particular a cold operating temperature is present, the spring 18 exerts a force on the actuating plunger 17, by means of which the actuating plunger 17 is extended. The actuating plunger 17 of the actuating device, which is formed integrally with an operating plunger of the safety device, thereby enters the slotted guide track 14. The slotted guide track 13 is formed in the same member as a slotted guide track 11 of the safety device 15. The cam element 12 is thereby displaced into the defined basic safety position, if it has previously been in the switching position and it is ensured that the cam element 12 is in its defined basic safety position in particular during a cold start of the internal combustion engine.

In order to also enable a switching of the valve operation with a low operating temperature, or with a cold internal combustion engine by means of the first actuator, the safety device 15 comprises a switch-off device 19. The switch-off device 19 comprises an electromagnetic unit, which is formed integrally with the electromagnetic unit 20 of the actuating device 20. In order to deactivate the safety device, the electromagnetic unit 20 is energized in such a manner that the force of the electromagnetic unit 20 on the actuating plunger 17 is opposite to the force of the spring means 18, whereby the actuating plunger 17 remains stable in the first position.

With a high operating temperature, the spring means 18 exerts a force on the actuating plunger 17, which is negligible, due to the arrangement as a bimetallic spring. The spring force is in particular so small that the actuating plunger 17 also remains stable in first position even without energization of the electromagnetic unit 20.

So that the actuating plunger 17 remains stable in two positions, it has a permanent magnet 24, which is arranged at one end of the actuating plunger 17. The permanent magnet 24 interacts with the actuator 23 in such a manner that a force acts on the actuating plunger 17 in the two end positions, which holds the actuating plunger 17 in the respective positions.

A spring of the safety device may for example also be a spring with a spring force which is independent of the operating temperature.

In this way, a force acts on the actuating plunger, which always biases it in the direction toward a slotted guide track. The safety device would then be deactivated by a constant energization of an electromagnetic unit, which is established when a valve operating device is to be moved to a switching position. By means of such a safety device, a cam element could be brought, during a malfunction of an actuating device, into a defined basic safety position independently of an operating temperature.

Furthermore, an actuation device is also conceivable, where a mechanical spring is replaced by a hydraulic means, utilizing the oil supply of an internal combustion engine. An oil pressure of the internal combustion engine is considerably larger in a cold engine operating state than in a warm engine operating state, whereby a safety device can be provided, which switches depending on an engine operating temperature. It is also conceivable with such a safety device to deactivate the safety device by means of an electromagnetic unit.

What is claimed is:

1. A valve operating device for an internal combustion engine, comprising at least one acuating device (10) which is provided to adjust an axially displaceable cam element (12) by means of at least one slotted guide track (13, 14) and at least one actuating plunger (17) movable into the guide track (13, 14), and a safety unit (15) which is provided to move the cam element (12) into a defined basic safety position in at least one operating mode, the safety unit (15) including a safety guide track (11) arranged on the cam element (12), the actuating device (10) including a bimetallic temperature dependent spring (18) acting on the actuating plunger (17) so as to engage the safety guide track (11) for moving the cam element (12) into the defined basic safety position upon occurrence of an error, and also for holding the plunger in engagement with the safety guide track (11) as long as the engine operating temperature is below a predetermined value.

2. The valve operating device according to claim 1, wherein the actuating device (10) and the safety unit (15) are at least partially formed in one piece.

3. The valve operating device according to claim 1, wherein the safety unit is a self-switching device.

4. The actuating device according to claim 1, wherein the safety unit (15) has a switch-off device (19) for deactivating the safety unit (15).

5. The actuating device according to claim 4, wherein the switch-off device (19) comprises an electromagnetic unit (20).

6. A method for a valve operating device for an internal combustion engine with at least one actuating device (10), which is provided to adjust an axially adjustable cam element (12) by means of at least one slotted guide track (13, 14), and a safety unit (15) with a bimetal temperature dependent spring (18), said method comprising the step of moving the cam element (12) by means of a safety unit (15) in at least one operating mode into a defined basic safety position in which continued operation of the internal combustion engine is ensured and the temperature-dependent bimetal spring (18) holding the cam element in the at least one operating mode as long as the engine temperature is below a threshold value.

* * * * *